United States Patent [19]

Shannon

[11] Patent Number: 4,679,275

[45] Date of Patent: Jul. 14, 1987

[54] PAINT SCRAPER

[76] Inventor: Timothy L. Shannon, 1901 Sackett Ave., Cuyahoga Falls, Ohio 44223

[21] Appl. No.: 837,298

[22] Filed: Mar. 7, 1986

[51] Int. Cl.[4] ..... B44D 3/16

[52] U.S. Cl. ..... 15/236 R; 30/161; 30/169

[58] Field of Search ..... 15/104.03, 104.05, 105, 15/111, 236 R, 245; 30/155, 156, 160, 161, 167, 167.1, 169; 7/105

[56] References Cited

U.S. PATENT DOCUMENTS

| | | | |
|---|---|---|---|
| 821,176 | 5/1906 | Leland | 30/169 X |
| 1,552,361 | 9/1925 | Trombley | 7/105 |
| 1,812,482 | 6/1931 | Hill | 15/104.03 |
| 3,789,450 | 2/1974 | Mozdenski et al. | 15/236 R X |
| 4,432,115 | 2/1984 | Fehler | 15/235.3 |

FOREIGN PATENT DOCUMENTS

| | | | |
|---|---|---|---|
| 491030 | 2/1930 | Fed. Rep. of Germany | 15/111 |
| 520480 | 3/1931 | Fed. Rep. of Germany | 15/105 |
| 127180 | 1/1950 | Sweden | 15/236 R |

*Primary Examiner*—Edward L. Roberts

*Attorney, Agent, or Firm*—Oldham, Oldham & Weber Co.

[57] ABSTRACT

A paint scraper having a pointed scraper head defined by angled edges of an elongated member which are chamfered at their point of interception. The elongated member is rotatably received by a sheath which functions as a handle in operation, and a means for storing the scraper head when not in operation.

15 Claims, 3 Drawing Figures

PAINT SCRAPER

TECHNICAL FIELD

The invention herein resides in the art of scrapers and, more particularly, to paint scrapers for removing paint from window panes and redepositing such paint onto the window sash before the paint has dried.

BACKGROUND ART

It is well known that windows are among the most difficult items to paint. Each pane of the window requires the painting of four small edges of the bars or sash encasing the pane. Time-consuming efforts are necessary to keep paint from the window pane during the painting operation. If paint is actually deposited on to the pane, removal by means of a rag or the painter's thumb is necessitated or, in many cases, the paint is allowed to dry and then is subsequently removed with a sharp implement such as a scraper or razor blade. Both techniques are time consuming, the latter and most popular requiring that the painter go over the window twice, a first time to paint the sash and bars, and a second subsequent time to remove the dried paint.

The art is devoid of a scraper which may effectively and reliably move paint from a window pane while the paint is still wet and deposit such paint back onto the area desired to be painted. Previously known scrapers have been incapable of use with wet paint or paint which has partially set-up. Known scrapers are set forth in U.S. Pat. No. 28,096, and design U.S. Pat. Nos. Des. 243,312, 163,774, 34,272, 32,484, 202,654, and 233,586. While all of these patents teach scrapers of various types, none are suitable for applicant's purposes of removing wet paint from a window pane.

DISCLOSURE OF INVENTION

In light of the foregoing, it is a first aspect of the invention to provide a paint scraper which can move undried paint from the glass of a window pane to the sash.

Another aspect of the invention is the provision of a paint scraper which allows for access to corners of the window pane.

Still a further aspect of the invention is the provision of a paint scraper which includes a sheath for protecting the scraping edges and point of the scraper when not in use.

Still another aspect of the invention is the provision of a paint scraper constructed of a material to allow for gliding of the scraper over glass, thus being easy to use.

Another aspect of the invention is to provide a paint scraper which is soft enough to wipe glass of wet paint, yet hard enough to remove partially dried paint.

Yet an additional aspect of the invention is to provide a paint scraper which includes a means for locking the scraping edges into either an operative position or a storage position as determined by the user.

The foregoing and other aspects of the invention which will become apparent as the detailed description proceeds are achieved by a paint scraper, comprising: an elongated member having a handle portion at a first end thereof and a scraper head portion at a second end thereof, said head portion defined by angled edges of said elongated member joining at a point; and wherein said angled edges are normal to top and bottom flat planar surfaces of said elongated member.

Yet other aspects of the invention are attained by a paint scraper, comprising: an elongated member having a pair of edges angled toward each other to a point at a first end thereof and defining a handle at a second end thereof; and wherein said point at said end is chamfered.

DESCRIPTION OF THE DRAWING

For a complete understanding of the objects, techniques and structure of the invention reference should be had to the following detailed description and accompanying drawing wherein.

BEST MODE FOR CARRYING OUT THE INVENTION

Figure 2:
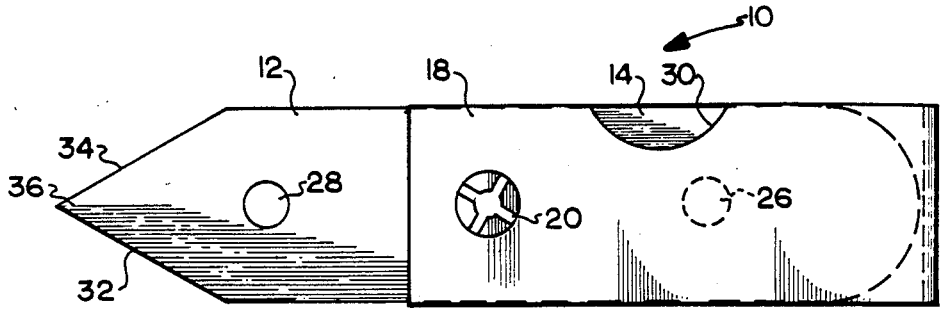
FIG. 2 is a top plan view of the paint scraper of the invention showing the scraper head in operative position outside of the sheath.

Referring now to the drawing, it can be seen that a paint scraper assembly according to the invention is designated generally by the numeral 10. The assembly 10 includes a scraper member 12 which comprises a handle portion 14 at one end thereof and a scraper head portion 16 at the opposite end. The scraper member 12 is preferably constructed of a strong but flexible plastic material such as nylon or teflon and is preferably 3–8 inches in length, 1–2 inches in width, and has a thichness of 1/16–$\frac{1}{4}$ inch. Of course, the specifics of the physical dimensions may vary.

Figure 1:
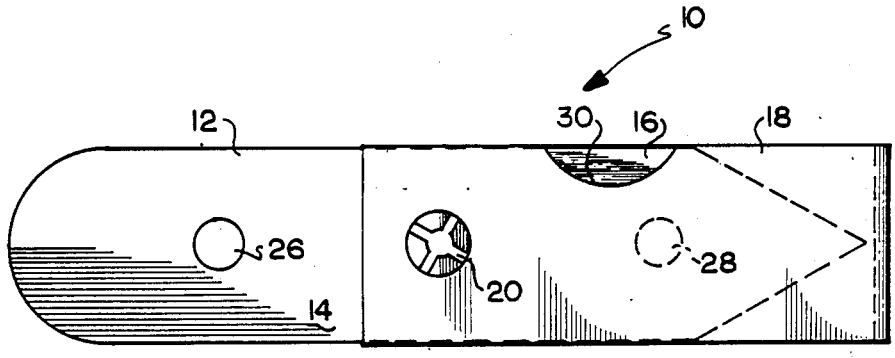
FIG. 1 is a top plan view of the paint scraper of the invention showing the scraper head received within the sheath.

An open-sided sheath 18 receives the scraper member 12 as shown in the drawing. The sheath 18 is preferably a U-shaped member constructed of plastic or the like and of substantially the same width as the scraper member 12 to receive such scraper member in total alignment as shown in FIGS. 1 and 2. The scraper member 12 is received by the sheath 18 by means of a pivot pin, bushing or grommet 20 passing through a hole in the scraper member 12 which is positioned between the handle portion 14 and the scraper head portion 16. As can be noted from a comparison of FIGS. 1 and 2, the scraper member 12 is rotatable about the pivot pin 20 and through the open-sided sheath 18.

Figure 3:
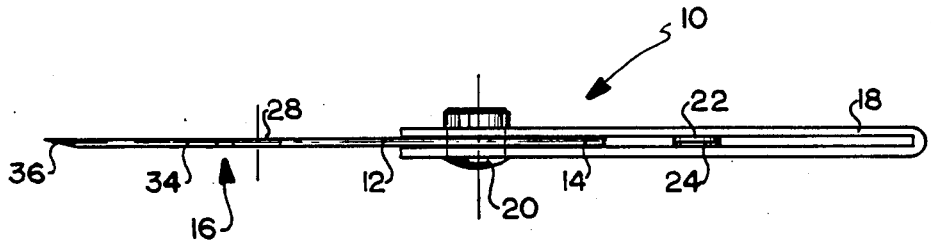
FIG. 3 is a partial sectional side view of the scraper of FIG. 2 showing the edges of the sheath and scraper.

As best seen in FIG. 3, lands, detents, or protusions 22 extend from opposite interior sides of the sheath 18 to be maintained opposite each other within the sheath. In a preferred embodiment, the lands 22 may have rounded or beveled edges and an opening therebetween which is of slightly less thickness than the thickness of the scraper member 12.

A hole 26 passes through the handle portion 14, while a hole 28 passes through the scraper head portions 16. The holes 26, 28 preferably lie in line with the pivot pin 20 and are positioned equidistant therefrom, a distant equivalent to the distance between the pivot pin 20 and the lands 22, 24. Accordingly, the lands 22, 24 may be received within the opening 28 as shown in FIG. 1 to store the scraper head portion 16 within the sheath 18, or may be received within the hole 26 as shown in FIG. 2 to retain the handle portion 14 within the sheath 18 to present the scraper head portion 16 in an operative position. Positioning the scraper member 12 in either of the positions of FIGS. 1 or 2 is facilitated by means of arcuate opening 30 in an edge of the sheath 18 to allow the user's thumb to access the member 12 to rotate the same about the pin 20 to either of the positions of FIGS. 1 or 2. It will be appreciated that there may be either one arcuate opening 30 in one of the sides of the sheath 18, or a pair of such openings 30 may be aligned on opposite sides of the sheath 18 to provide for a total arcuate opening through the sheath 18 for accessing the scraper member 12.

Best shown in FIGS. 2 and 3, the scraper head portion 16 is characteried by angled edges 32, 34 forming a point or apex having an angle of 40°–90°. The angled edges 32, 34 are normal or perpendicular to the parallel top and bottom flat planar surfaces of the scraper head portion 16. In other words, when the scraper head portion is horizontal, the edges 32, 34 are vertical. Finally, as best shown in FIG. 3, the apex or point 36 is chamferred or beveled to define a sharp point at the end thereof. The extent of the chamferring may vary, but it is preferred that the chamfer extend from the bottom to the top of the head portion 16 over a distance equal to 2–6 times the thickness of the head portion 16, but preferably 4 times such thickness. This chamfered point allows for ease of access of the paint scraper into corners without marring or touching the bars or window sash of the panes.

In operation, the scraper member 12 is rotated about the pin 20 to the position of FIG. 2, with the hole 26 receiving the lands 22, 24. The user or painter, having painted the sash and bars about the window pane, then places the scraper head portion 16 against the window pane, with the flexible nature of the material of the assembly 10 allowing the sheath 18 and handle portions 16 to be bent upwardly, causing the head to apply pressure to the window pane with the edges 32, 34 flush with the pane. The point 36 is then introduced to a corner of the window pane and against the sash with the chamfered or beveled surface up. The scraper head portion 16 is then drawn along the window sash or bar with an appropriate leading edge 32, 34 contacting the undried paint on the window pane, urging it along that edge, for deposit onto the bar or sash. Should an excess paint build-up develop on the scraper head 16, the same may be readily removed by wiping with a cloth. The plastic nature of the assembly 10 allows for good wiping contact with the glass and ease of movement thereacross. The chamfered point 36 allows for contact with the sash or bars at the line of engagement with the glass pane without marring the paint previously deposited on the bars or sash. When use is completed, the scraper member 12 may be rotated to the position of FIG. 1, with the edges 32, 34 and point 36 safely received within the sheath 18, and the assembly 10 may then be deposited into the painter's pocket. At the completion of the job, the assembly 10 may be stored as by hanging it from a hook passing through the hole 26.

Thus it can be seen that the objects of the invention have been satisfied by the structure presented herein above. While in accordance with the patent statutes only the best mode and preferred embodiment of the invention have been presented and described in detail, the scope of the invention is not limited thereto and thereby. Accordingly, for an appreciation of the true scope and breadth of the invention reference should be had to the following claims.

What is claimed is:

1. A paint scraper, comprising: an elongated member having a handle portion at a first end thereof and a scraper head portion at a second end thereof, said head portion defined by angled edges of said elongated member joining at a point, said angled edges being normal to top and bottom flat planar surfaces of said elongated member, said elongated member being received by a sheath at a pivot point between said handle and head portion.

2. The paint scraper according to claim 1 wherein said point is chamferred from said bottom surface to said top surface.

3. The paint scraper according to claim 2 wherein said point is defined by an angle of 40°–90°.

4. The paint scraper according to claim 3 wherein said point is chamfered an axial length equal to between 2 and 6 times a thickness of said elongated member as measured between said top and bottom surfaces.

5. The paint scraper according to claim 1 wherein said sheath is open-sided, said elongated member being rotatable about said pivot point and through said sheath.

6. The paint scraper according to claim 5 wherein said sheath and elongated member have means for interlocking with each other.

7. The paint scraper according to claim 6 wherein said interlocking means comprises a protrusion extending from an inside surface of said sheath and for mating with a hole in said elongated member.

8. The paint scraper according to claim 7 wherein said elongated member is characterized by two holes, one in each of said handle portion and said head portion, said holes being equidistant from said pivot point.

9. The paint scraper according to claim 8 wherein said sheath includes a pair of protrusions extending from opposite inside surfaces thereof and in juxtaposition to each other.

10. The paint scraper according to claim 7 wherein said sheath is characterized by an opening in an edge thereof exposing a portion of said elongated member.

11. A paint scraper, comprising: an elongated member having a pair of edges angled toward each other to a point at a first end thereof and defining a handle at a second end thereof, said point at said first end being chamfered, said angled edges being normal to first and second parallel planar surfaces of said elongated member, said elongated member being received within a sheath and rotatable through said sheath about a pivot point.

12. The paint scraper as recited in claim 11 wherein said sheath has first locking means for engaging second locking means in said elongated member for securing said elongated member in a fixed relation to said sheath.

13. The paint scraper as recited in claim 12 wherein said first locking means comprises a pair of protrusions, opposite each other interior of said sheath, and said locking means is defined by a pair of holes in said elongated member, equidistance from and on opposite sides of said pivot point.

14. The paint scraper as recited in claim 11 wherein said pair of edges form an angle of 40°–90°.

15. The paint scraper as recited in claim 11 wherein said point is chamfered a distance of 2–6 times a thickness of said elongated member.

* * * * *